US007819671B2

(12) United States Patent
Liu et al.

(10) Patent No.: US 7,819,671 B2
(45) Date of Patent: Oct. 26, 2010

(54) ELECTRICAL CONNECTOR HAVING TERMINALS WITH IMPROVED WIPING CAPABILITY

(75) Inventors: Jia-Hau Liu, Tu-cheng (TW); Fu-Pin Hsieh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/313,952

(22) Filed: Nov. 26, 2008

(65) Prior Publication Data

US 2009/0203235 A1 Aug. 13, 2009

(30) Foreign Application Priority Data

Nov. 26, 2007 (CN) ..... 2007 2 0041654 U

(51) Int. Cl.
*H01K 7/00* (2006.01)
*H01K 11/00* (2006.01)

(52) U.S. Cl. ..... 439/66; 439/83; 439/342

(58) Field of Classification Search ..... 439/66, 439/81, 83, 342
See application file for complete search history.

(56) References Cited

U.S. PATENT DOCUMENTS 4,505,529 A * 3/1985 Barkus ..... 439/82
4,553,192 A 11/1985 Babuka et al.
6,296,495 B1 10/2001 Wang et al.
7,172,431 B2 * 2/2007 Beaman et al. ..... 439/66
7,255,573 B2 * 8/2007 He et al. ..... 439/66
7,422,439 B2 * 9/2008 Rathburn et al. ..... 439/66
7,479,015 B2 * 1/2009 Ruttan et al. ..... 439/66

* cited by examiner

*Primary Examiner*—Michael C Zarroli
(74) *Attorney, Agent, or Firm*—Andrew C. Cheng; Wei Te Chung; Ming Chieh Chang

(57) ABSTRACT

An electrical connector (100) includes a first insulative housing (1), a second insulative housing (2), a soldering contact (4) positioned in the second insulative housing (2) for electrically connecting with a circuit substrate and an electrical contact (3) made of wire, the electrical contact (3) comprising a first retention portion (31) positioned in the first insulative housing (1) with a contacting portion (311) extending beyond the first insulative housing (1) for electrically connecting to an electronic package, a spring portion (32) and a second retention portion (33) positioned in the second insulative housing (2) connected with the soldering contact (4), when the electrical contact (3) is pressed down by the electronic package, the spring portion (32) expanded outwardly and the electrical contact (3) only moves along up-to-down direction, thus make the contacting portion (311) engages with the electronic package with minimal wiping length.

13 Claims, 5 Drawing Sheets

ELECTRICAL CONNECTOR HAVING TERMINALS WITH IMPROVED WIPING CAPABILITY

BACKGROUND OF THE INVENTION

1. Field of the Invention

The present invention relates to an electrical connector, and particularly to an electrical connector having contact terminal made from wire so as to provide excellent wiping capability against pads of an electronic package.

2. Description of the Prior Art

Electrical connectors are widely used in electrically connecting electronic packages such as Land Grid Array (LGA) Central Processing Units (CPUs) with circuit substrates such as printed circuit boards (PCBs). Patented examples of such electrical connectors are disclosed in U.S. Pat. No. 4,553,192 issued to IBM on Aug. 25, 1983 and U.S. Pat. No. 6,296,495 issued to Hon Hai on Mar. 23, 2000.

Referring to FIG. 1, a conventional electrical connector connecting a CPU 51 with a PCB 61 is illustrated. The connector comprises an insulative housing 81 and a multiplicity of terminals 91 received in the housing 81. The housing 81 defines a multiplicity of passageways 810 therethrough, for receiving a corresponding terminals 91 therein.

Each terminal 91 comprises a retaining body 911 engagingly received in a corresponding passageway 810, a soldering portion 912 extending perpendicularly from a bottom end of the retaining body 911, and a cantilevered arm 913 extending slantingly upwardly from a top end of the retaining body 911 and formed with a curved contacting portion 9131 at the free end thereof. The soldering portion 912 electrically connects with the pad 612 of the PCB 61 via a solder ball 71, and the cantilevered arm 913 substantially protrudes beyond a top surface of the housing 81 with the contacting portion 9131 compressed by pads 512 of a CPU 51 for electrically connecting with the CPU 51, the connector thus electrically connects the CPU 51 with the PCB 61.

When the contacting portion 9131 of the terminal 91 engages with the pad 512, the cantilevered arm 913 rotates about a junction of the cantilevered arm 913 and the retaining body 911. The rotation comprises the component horizontal displacement and the component vertical displacement. Therefore, the effect of the horizontal displacement makes the cantilevered arm 913 wipes the pad 512 relative to the CPU 51 a certain distance during the downward movement of the CPU 51. The relatively long wiping length of the terminals 91 results in poor connection between the contacting portion 9131 and the pad 512.

In view of the above, a new electrical connector that overcomes the above-mentioned disadvantages is desired.

SUMMARY OF THE INVENTION

Accordingly, the object of the present invention is to provide an electrical connector having a plurality of minimal wiping terminals capable of reliably electrically connecting an electronic package, such as a land grid array (LGA) central processing unit (CPU), with a circuit substrate, such as a printed circuit board (PCB).

To fulfill the above-mentioned object, an electrical connector in accordance with a preferred embodiment of the present invention comprises a first insulative housing, a second insulative housing, a soldering contact positioned in the second insulative housing for electrically connecting with a circuit substrate and an electrical contact made of wire, the electrical contact comprising a first retention portion positioned in the first insulative housing with a contacting portion extending beyond the first insulative housing for electrically connecting to an electronic package, a second retention portion positioned in the second insulative housing connected with the soldering contact and a spring portion between the first retention portion and the second retention portion, when the electrical contact is pressed down by the electronic package, the spring portion expanded outwardly to make a good elasticity of the electrical contact.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
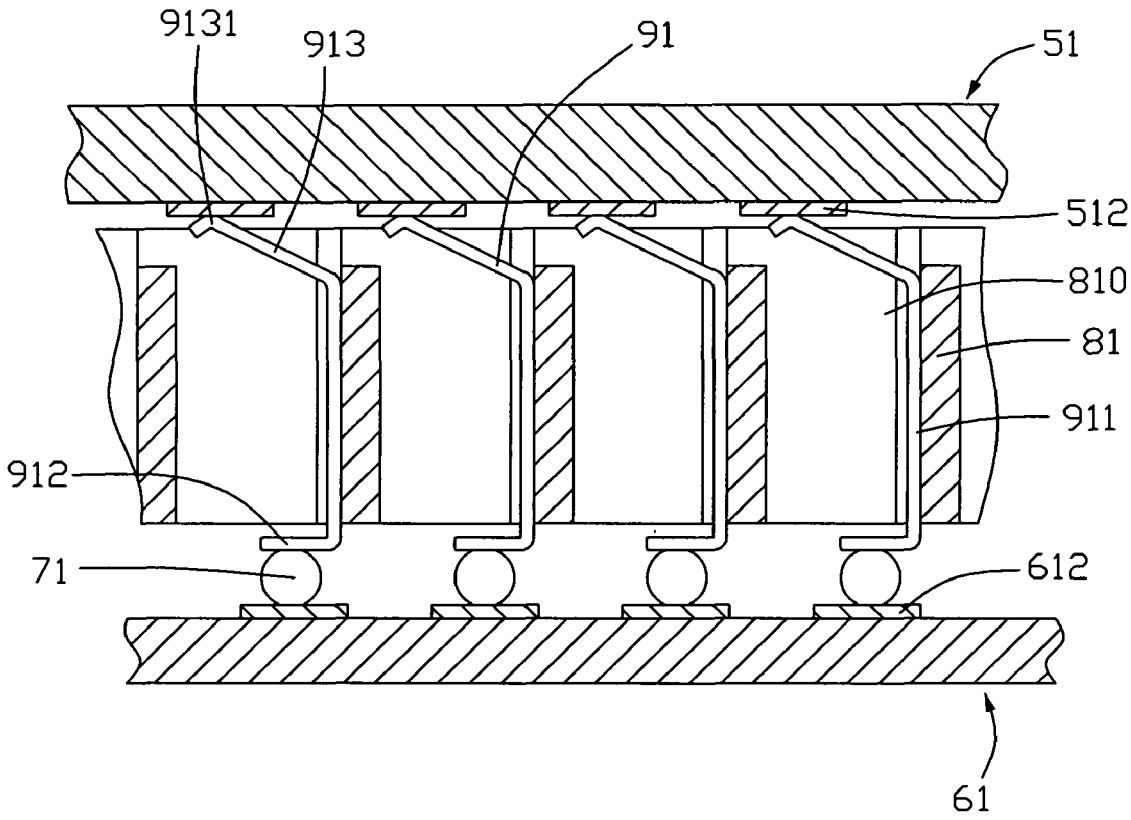
FIG. 1 (PRIOR ART)
FIG. 1 is a schematic, cross-sectional view of part of a conventional connector, showing a soldering portions of the conventional contact connected with a corresponding part of a PCB via solder balls, and a corresponding part of an LGA CPU above the connector ready to be connected with the terminal.
Figure 2:
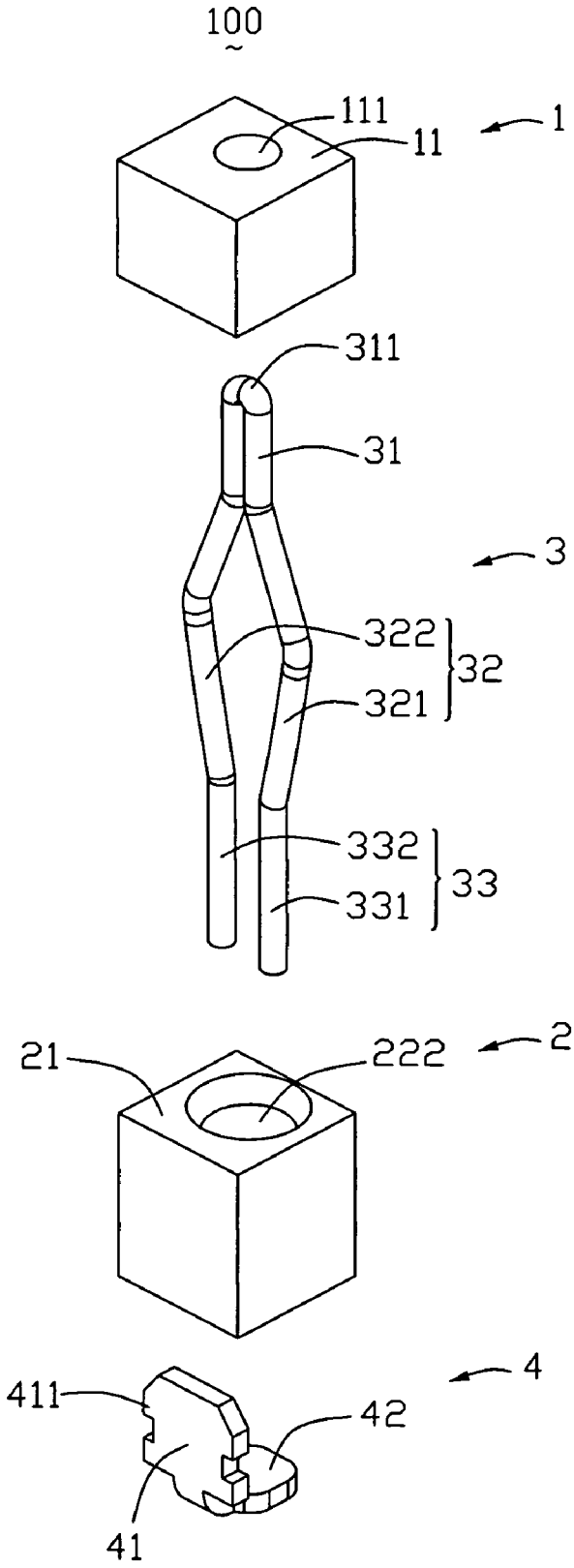
FIG. 2 is an exploded view of an electrical connector of the present invention, only showing a part of the electrical connector.
Figure 3:
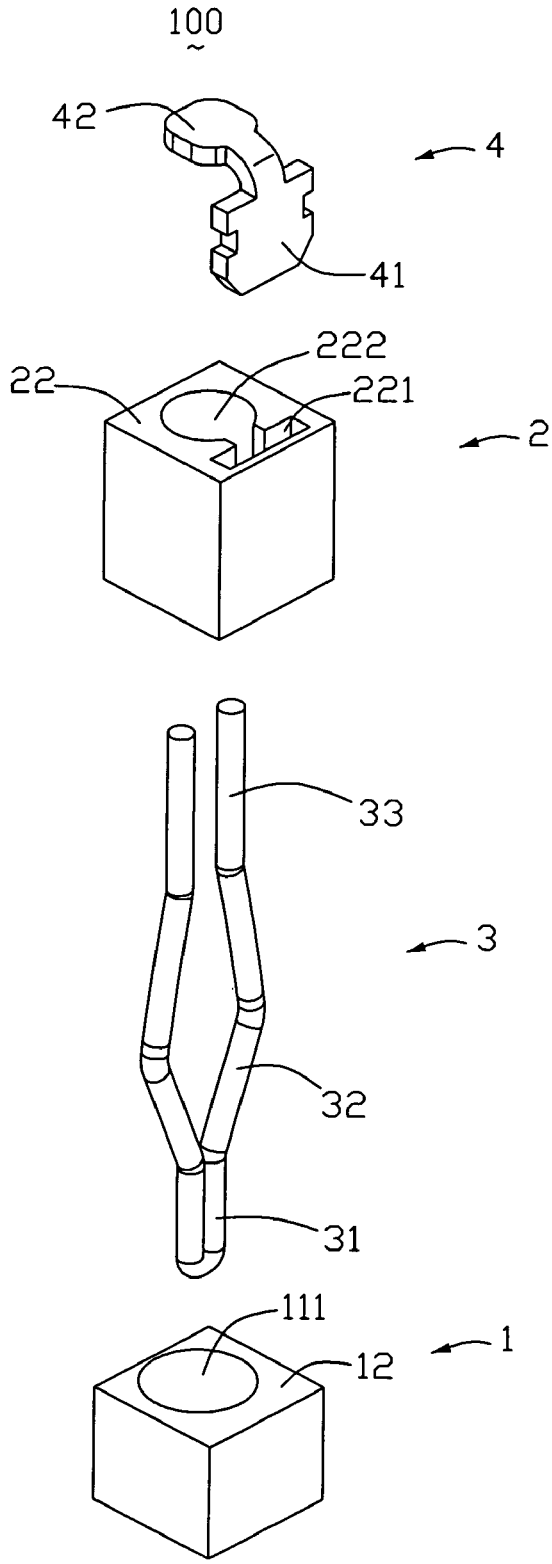
FIG. 3 is a bottom view of FIG. 2.

Referring to FIGS. 2 and 3, an electrical connector 100 in accordance with the preferred embodiment of the present invention is used for electrically connecting an electronic package, such as a land grid array (LGA) central processing unit (CPU) (not shown), with a circuit substrate, such as a printed circuit board (PCB) (not shown). The connector 100 comprises a first insulative housing 1, a second insulative housing 2, a plurality of electrical contacts 3 and a plurality of soldering contacts 4. For simplification, only shown one section of the first insulative housing 1 and the second insulative housing 2, and also only one electrical contact 3 and one soldering contact 4 are shown.

The first insulative housing 1 with a rectangular shape comprises a supporting surface 11 for receiving the CPU and a underside surface 12 opposite to the supporting surface 11. The supporting surface 11 comprises a plurality of first passageways 111 going through the underside surface 12. Please referring to FIG. 5, the size of the first passageways 111 on the supporting surface 11 is smaller than that on the underside surface 12.

The second insulative housing 2 with a rectangular shape comprises a fixing surface 22 for being assembled to the PCB and a top surface 21 opposite to the fixing surface 22. The fixing surface 22 comprises a plurality of second passageways 222 going through the top surface 21 and a plurality of receiving recesses 221 extending to the inner of the second insulative housing 2. The receiving recess 221 is connected with the second passageway 222.

The electrical contacts 3 are made of wire and each comprises a first retention portion 31, a second retention portion 33 and a spring portion 32 between the first retention portion 31 and the second retention portion 33. The first retention portion 31 comprises a contacting portion 311 at the free end thereof for electrically connecting with the CPU. Referring to FIG. 2, the first retention portion 31 with U-shaped configuration has two legs touched with each other. The spring portion 32 extends downwardly and outwardly from the two legs of the first retention portion 31 and comprises a first spring portion 321 and a second spring portion 322. The first spring portion 321 and the second spring portion 322 each extends curvedly far away from each other to form a V-shaped configuration. The V-shaped configuration forms a first angle. The second retention portion 33 comprises a third retention portion 331 extends downwardly from the first spring portion 321 and a fourth retention portion 332 extends downwardly from the second spring portion 322. The third retention portion 331 is paralleled with the fourth retention portion 332 and the distance of the two retention portions 331, 332 is larger than the diameter of the second passageways 222 of the second insulative housing 2.

The soldering contact 4 with an L-shaped configuration comprises a vertical base portion 41 and a leveled soldering portion 42 extending curvedly from the base portion 41. The base portion 41 comprises a number of barbs 411.

Figure 4:
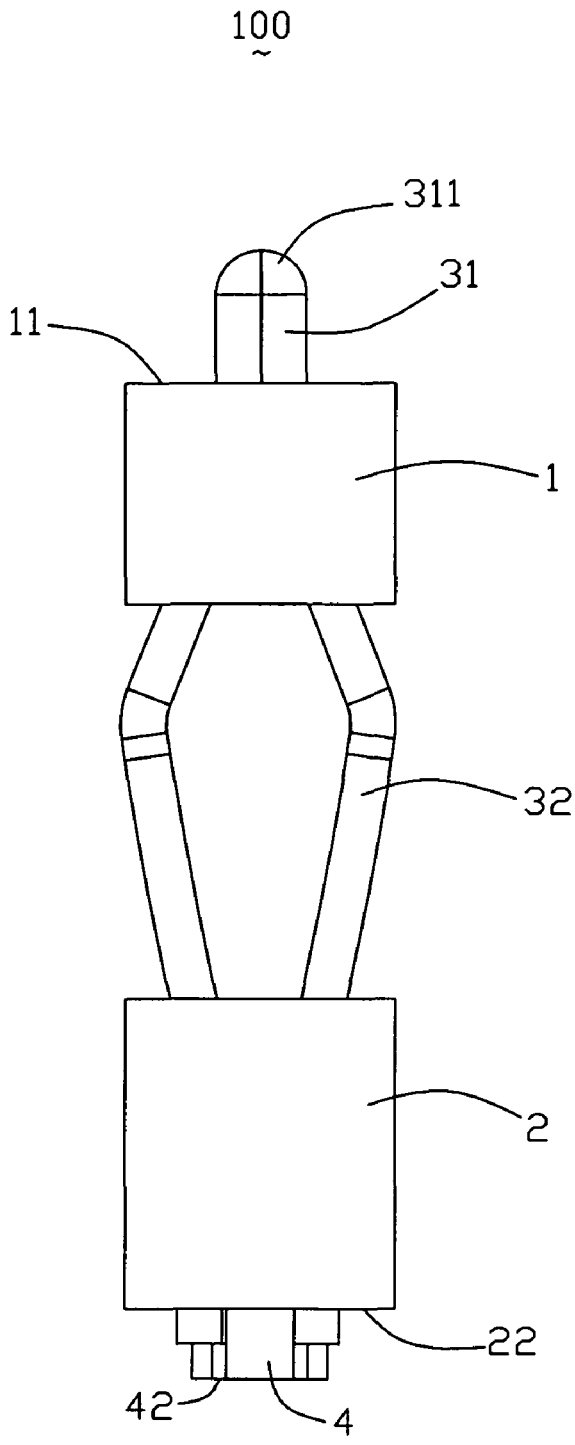
FIG. 4 is an assembly view of FIG. 2.
Figure 5:
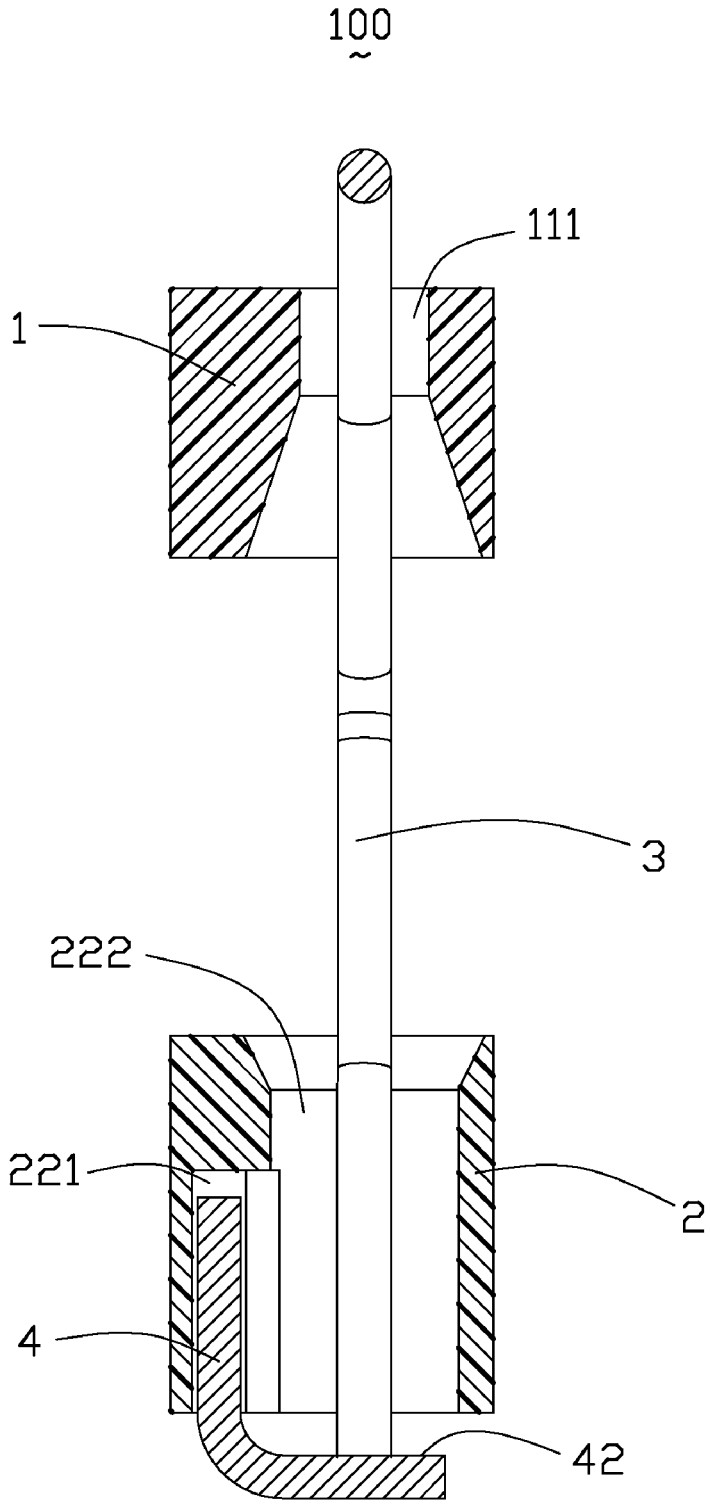
FIG. 5 is a schematic, cross-sectional view of FIG. 4.

Referring to FIG. 4 and FIG. 5, when the electrical connector 100 is assembled. The first retention portion 31 of the electrical contact 3 is received in the first passageway 111 of the first insulative housing 1 and can move in the first passageway 111 along an up-to-down direction. The contacting portion 311 extends beyond the supporting surface 11. The second retention portion 33 is received in the second passageway 222 of the second insulative housing 2. As the distance between the third retention portion 331 and the fourth retention portion 332 is larger than the diameter of the second passageway 222, the second retention portion 33 can be securely positioned in the second passageway 222 due to the compress force exerted by the second passageway 222.

The soldering contact 4 is positioned in the receiving recess 221 and the soldering portion 42 extends beyond the fixing surface 22 for electrically connecting with the PCB. The barbs 411 interference with the second insulative housing 2 for securely positioning the soldering contact 4 in the second insulative housing 2. The second retention portion 33 goes through the second passageway 222 to connect with the soldering portion 42 of the soldering contact 4.

When the contacting portion 311 is pressed down by the CPU, the first insulative housing 1 is settled on the retention portion 31 floatable, the first spring portion 321 and the second spring portion 322 each moves far away from each other to provide a good elasticity of the electrical contact 3. At this moment, the V-shaped configuration of the two spring portions 321, 322 forms a second angle and the first angle is larger than the second angle. The electrical contact 3 only moves along up-to-down direction, thus make the contacting portion 311 therefore engages with the CPU with minimal wiping length.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting an electronic package with a circuit substrate, comprising:

a first insulative housing;

a second insulative housing comprising a fixing surface for being assembled to the circuit substrate and a top surface opposite to the fixing surface, the fixing surface comprising a receiving recess extends into the second insulative housing;

a plurality of soldering contacts positioned in the receiving recess of the second insulative housing; and a plurality of electrical contacts separated from the soldering contacts and each comprising a first retention portion positioned in the first insulative housing with a contacting portion extending beyond the first insulative housing, a second retention portion positioned in the second insulative housing and electrically connected with the soldering contact, and a spring portion between the first retention portion and the second retention portion, when the electrical contact is pressed down by the electronic package, the spring portion expands outwardly.

2. The electrical connector as claimed in claim 1, wherein the spring portion comprises a first spring portion and a second spring portion each forming a V-shaped configuration.

3. The electrical connector as claimed in claim 1, wherein the second insulative housing comprises a first passageway, the second retention portion comprises a third retention portion and a fourth retention portion paralleled with each other, the distance between the third retention portion and the fourth retention portion is larger than the diameter of the second passageway.

4. The electrical connector as claimed in claim 1, wherein the first insulative housing comprises a supporting surface for receiving the electronic package and a bottom surface opposite to the supporting surface, the supporting surface comprises a passageway goes through the bottom surface.

5. The electrical connector as claimed in claim 4, wherein the first retention portion of the electrical contact is received in the first passageway and can move along an up-to-down direction in the first passageway.

6. The electrical connector as claimed in claim 1, wherein the soldering contact comprises a base portion and a soldering portion extending from the base portion.

7. The electrical connector as claimed in claim 6, wherein the base portion comprises a plurality of barbs interfered with the second insulative housing.

8. The electrical connector as claimed in claim 6, wherein the second retention portion of the electrical contact is connected with the soldering portion of the soldering contact.

9. An electrical connector for connecting an electronic package with a circuit substrate, comprising:

an insulative housing; and a plurality of electrical contacts made of wire received in the insulative housing and comprising a first portion and a second portion symmetrical with the first portion, the first portion comprising a first retention portion, a second retention portion and a spring portion connecting the first retention portion with the second retention portion and protruding outwardly from the first and second retention portion, the second portion connected with the first portion at a top end of the first retention portion, the second retention portions of the first portion and the second portion defining a distance therebetween, the spring portion expanded outwardly when the electrical contact is pressed down by the electronic package;

wherein the electrical connector also comprises a soldering contact connecting with the first portion or the second portion, the soldering contact comprises a base portion and a soldering portion extending from the base portion.

10. The electrical connector as claimed in claim 9, wherein the spring portion comprises a first spring portion and a second spring portion each forming a V-shaped configuration.

11. The electrical connector as claimed in claim 9, wherein the base portion comprises a plurality of barbs.

12. The electrical connector as claimed in claim 9, wherein the second retention portion of the electrical contact is connected with the soldering portion of the soldering contact.

13. An electrical connector for connecting an electronic package with a circuit substrate, comprising:

a first insulative housing and a second insulative housing spaced from each other;

a plurality of electrical contacts disposed in the first insulative housing;

a plurality of soldering contacts disposed in the second insulative housing, said soldering contacts and said electrical contacts being arranged with pairs under condition that in each pair the electrical contact and the corresponding soldering contact are discrete from each other while being contacting each other for electrical connection therebetween;

each of said electrical contacts comprising a first portion positioned in the first insulative housing with a contacting portion extending beyond the first insulative housing, a second portion positioned in the second insulative housing to contact the corresponding soldering contact, and a spring portion between the first portion and the second portion; wherein the electrical contact is made from a wire with an closed end on the first portion and an open end on the second portion to contact the corresponding soldering contact, and when the electrical contact is pressed down by the electronic package, the spring portion expands outwardly.

* * * * *